US006885274B2

(12) United States Patent
Hsu et al.

(10) Patent No.: US 6,885,274 B2
(45) Date of Patent: Apr. 26, 2005

(54) INDUCTOR MODULE INCLUDING INDUCTOR WINDINGS WOUND ON A COMMON INDUCTOR CORE

(75) Inventors: Chien-Chi Hsu, Chung-Ho (TW); Chih-Sheng Li, Chung-Ho (TW); Yung-Kuang Lee, Chung-Ho (TW); Guo-Yang Wu, Chung-Ho (TW)

(73) Assignee: Micro-Star Int'l Co., Ltd., Jung-He (TW)

( * ) Notice: Subject to any disclaimer, the term of this patent is extended or adjusted under 35 U.S.C. 154(b) by 61 days.

(21) Appl. No.: 10/434,084

(22) Filed: May 9, 2003

(65) Prior Publication Data

US 2004/0160298 A1 Aug. 19, 2004

(30) Foreign Application Priority Data

Feb. 14, 2003 (TW) ..... 92202417 U

(51) Int. Cl.[7] ..... H01F 27/29

(52) U.S. Cl. ..... 336/192; 336/182; 336/184

(58) Field of Search ..... 336/83, 175, 176, 336/192, 212, 222, 223; 363/16

(56) References Cited

U.S. PATENT DOCUMENTS 6,304,460 B1 * 10/2001 Cuk ..... 363/16

* cited by examiner

*Primary Examiner*—Ramon M. Barrera
(74) *Attorney, Agent, or Firm*—Winston Hsu

(57) ABSTRACT

An inductor module includes a common inductor core, and first and second inductor windings. Each of the first and second inductor windings has an input end, an output end, and an inductor winding section disposed between the input and output ends. The inductor winding sections are wound on the common inductor core such that the distance between the input end of the first inductor winding and the output end of the second inductor winding is larger than the distance between the output end of the first inductor winding and the input end of the second inductor winding. The output end of the first inductor winding is free of an electrical connection with the input end of the second inductor winding.

11 Claims, 3 Drawing Sheets

INDUCTOR MODULE INCLUDING INDUCTOR WINDINGS WOUND ON A COMMON INDUCTOR CORE

CROSS-REFERENCE TO RELATED APPLICATION

This application claims priority of Taiwanese application no. 092202417, filed on Feb. 14, 2003.

BACKGROUND OF THE INVENTION

1. Field of the Invention

The invention relates to an inductor, more particularly to an inductor module that includes inductor windings wound on a common inductor core.

2. Description of the Related Art

Inductor modules that include plural inductor windings wound on a common inductor core are known in the art. In commonly assigned U.S. patent application Ser. No. 10/337,830, filed on Jan. 8, 2003, there is disclosed an inductor module that includes a common inductor core and an inductor winding. The inductor winding includes a plurality of inductor winding sections, each of which has a first end and a second end, and each of which is wound on the common inductor core. The inductor winding further includes a common contact interconnecting the second ends of the inductor winding sections.

It is desirable to provide an inductor module with inductor windings on a common inductor core that has characteristics, such as reduced ripple current and increased current saturation levels.

SUMMARY OF THE INVENTION

According to the present invention, an inductor module comprises a common inductor core, and first and second inductor windings.

The common inductor core has first and second lateral core portions. Each of the first and second inductor windings has an input end, an output end, and an inductor winding section disposed between the input and output ends. The inductor winding section of each of the first and second inductor windings is wound on a respective one of the first and second lateral core portions of the common inductor core such that the input end of the first inductor winding and the output end of the second inductor winding form a first distance therebetween and such that the output end of the first inductor winding and the input end of the second inductor winding form a second distance therebetween. The second distance is smaller than the first distance. The output end of the first inductor winding is free of an electrical connection with the input end of the second inductor winding.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
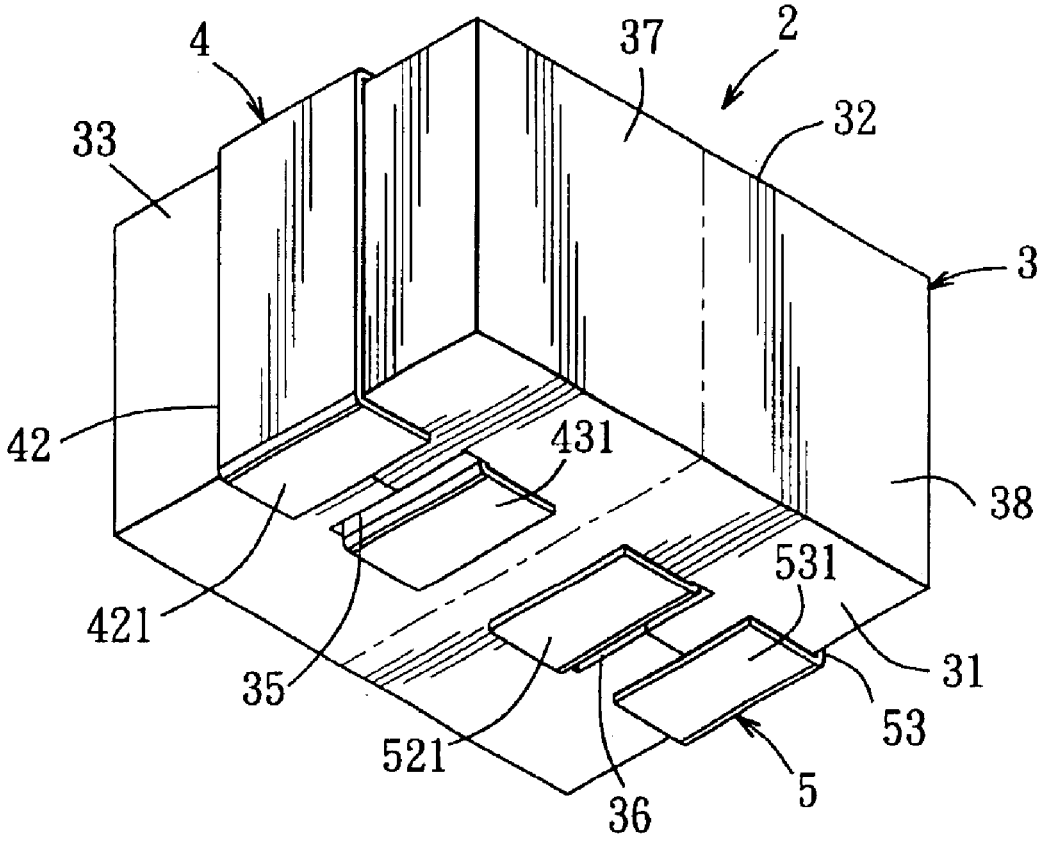
FIG. 1 is a perspective view of the first preferred embodiment of an inductor module according to the present invention.

Before the present invention is described in greater detail, it should be noted that like elements are denoted by the same reference numerals throughout the disclosure.

Referring to FIG. 1, the first preferred embodiment of an inductor module 2 according to the present invention is shown to include a common inductor core 3, and first and second inductor windings 4, 5.

The common inductor core 3 has first and second lateral core portions 37, 38. Preferably, the common inductor core 3 is made of a magnetic material, and includes a first surface 31, a second surface 32 opposite to the first surface 31, and a peripheral surface 33 extending between the first and second surfaces 31, 32. In this embodiment, the common inductor core 3 has a pair of through holes 35, 36 extending from the first surface 31 through the second surface 32.

Figure 2:
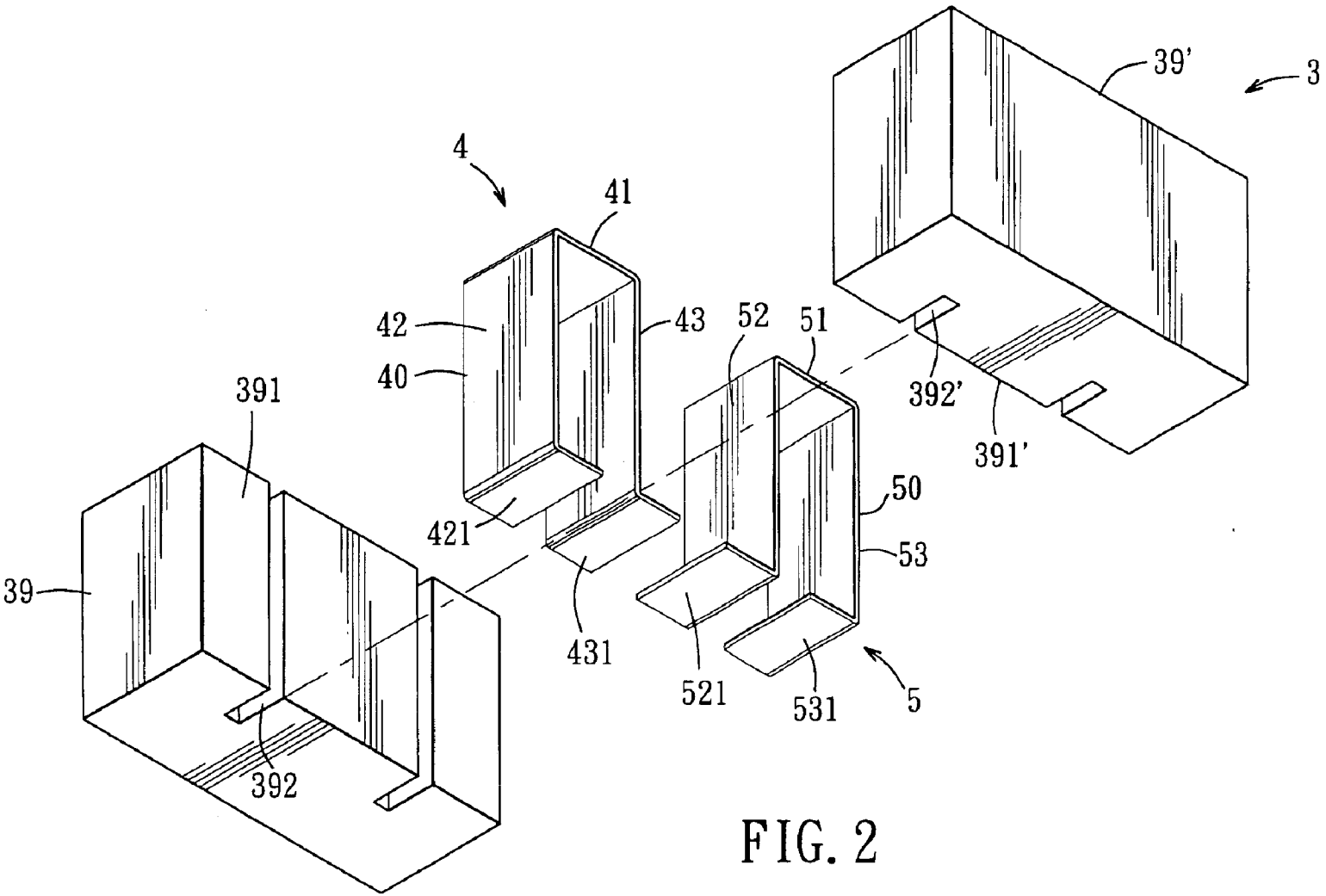
FIG. 2 is an exploded perspective view of the first preferred embodiment.

With further reference to FIG. 2, the common inductor core 3 includes complementary core parts 39, 39', each of which is formed with a pair of grooves 392, 392'. Each of the through holes 35, 36 is defined by a confronting pair of the grooves 392, 392' in the core parts 39, 39'.

Each of the first and second inductor windings 4, 5 has an input end 421, 521, an output end 431, 531, and an inductor winding section 40, 50 disposed between the input and output ends 421, 521, 431, 531.

The inductor winding section 40, 50 of each of the first and second inductor windings 4, 5 is generally inverted-U in shape, and is wound on a respective one of the first and second lateral core portions 37, 38 of the common inductor core 3 such that the input end 421 of the first inductor winding 4 and the output end 531 of the second inductor winding 5 form a first distance therebetween and such that the output end 431 of the first inductor winding 4 and the input end 521 of the second inductor winding 5 form a second distance therebetween. In this embodiment, the second distance is smaller than the first distance. In particular, the inductor winding section 40 of the first inductor winding 4 has a first segment 43 that extends from the output end 431 of the first inductor winding 4 and into a respective one of the through holes 35, a second segment 41 that extends from the first segment 43 and along the second surface 32 of the common inductor core 3, and a third segment 42 that extends from the second segment 41 and along the peripheral surface 33 of the common inductor core 3. Similarly, the inductor winding section 50 of the second inductor winding 5 has a first segment 52 that extends from the input end 521 of the second inductor winding 5 and into a respective one of the through holes 36, a second segment 51 that extends from the first segment 52 and along the second surface 32 of the common inductor core 3, and a third segment 53 that extends from the second segment 51 and along the peripheral surface 33 of the common inductor core 3. In this embodiment, the input and output ends 421, 521, 431, 531 of each of the first and second inductor windings 4, 5 extend along and lie against the first surface 31 of the common inductor core 3. It is noted that the output end 431 of the first inductor winding 4 is free of an electrical connection with the input end 521 of the second inductor winding 5. Preferably, each of the first and second inductor windings 4, 5 is formed from a conductive foil, such as a copper foil, which is a good heat dissipating material. Further, insulator layers are provided on outer surfaces of the first and second inductor windings 4, 5 to prevent direct contact between the conductive foil and the inductor core 3, thereby avoiding interference therebetween.

When assembling the inductor module 2, the first segments 43, 52 of the inductor winding sections 40, 50 are initially received in the grooves 392 in one of the core parts 39. The core parts 39, 39' are then brought toward each other such that the sides 391, 391' face each other and that the first segments 43, 52 of the inductor winding sections 40, 50 are simultaneously received in the grooves 392, 392' in the core parts 39, 39'.

Once assembled, the input and output ends 421, 521, 431, 531 of each of the first and second inductor windings 4, 5 are disposed to lie against the first surface 31 of the inductor core 3, the first segments 43, 52 of the inductor winding sections 40, 50 extend respectively into the through holes 35, 36 defined by the grooves 392, 392' in the core parts 39, 39', the second segments 41, 51 of the inductor winding sections 40, 50 extend along the second surface 32 of the inductor core 3, and the third segments 42, 53 of the inductor winding sections 40, 50 extend along the peripheral surface 33 of the inductor core 3. Since the input and output ends 421, 521, 431, 531 of the inductor module 2 lie on the same plane of the first surface 31 of the inductor core 3, the inductor module 2 is ideal for Surface Mount Technology assembly to facilitate mounting of the same on a circuit board (not shown). Further, to reduce the space requirement of the inductor module 2, the input end 421 of the first inductor winding 4 extends toward the output end 431 of the first inductor winding 4. Similarly, the output end 531 of the second inductor winding 5 extends toward the input end 521 of the second inductor winding 5.

Figure 3:
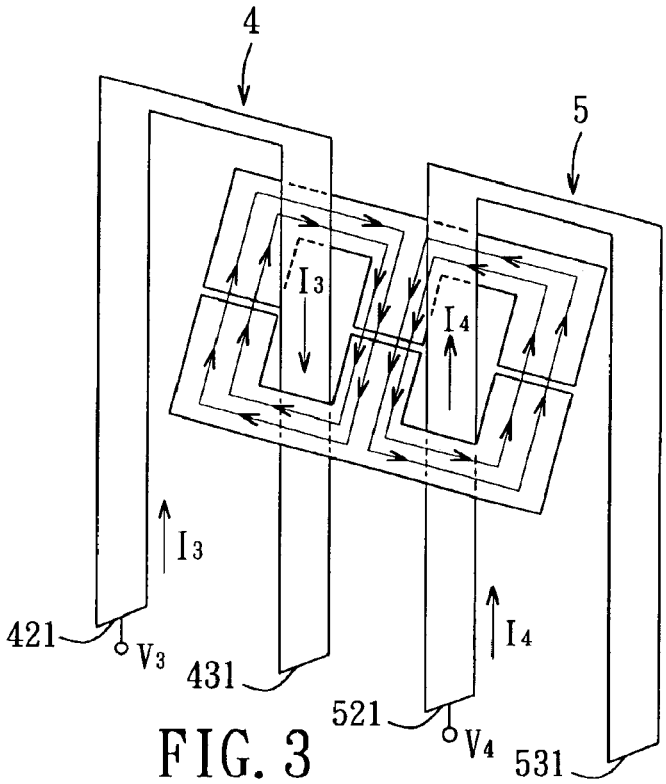
FIG. 3 is a perspective view to illustrate flow of currents through and magnetic flux between first and second inductor windings of the first preferred embodiment.

With further reference to FIG. 3, when a voltage ($V_3$) is applied at the input end 421 of the first inductor winding 4, a current ($I_3$) flows from the input end 421 to the output end 431 of the first inductor winding 4. This results in a mutual inductance ($M_{21}$) of the second inductor winding 5 with respect to the first inductor winding 4. The mutual inductance ($M_{21}$) can be calculated from the formula $$V_3=L_3di_3/dt+M_{21}di_4/dt$$

where $L_3$ is the inductance of the first inductor winding 4, $di_3/dt$ is the instantaneous current flowing through the first inductor winding 4, and $di_4/dt$ is the instantaneous current flowing through the second inductor winding 5. Similarly, when a voltage ($V_4$) is applied at the input end 521 of the second inductor winding 5, a current ($I_4$) flows from the input end 521 to the output end 531 of the second inductor winding 5. This results in a mutual inductance ($M_{12}$) of the first inductor winding 4 with respect to the second inductor winding 5. The mutual inductance ($M_{12}$) can be calculated from the formula $$V_4=L_4di_4/dt+M_{12}di_3/dt$$

where $L_4$ is the inductance of the second inductor winding 5, $di_4/dt$ is the instantaneous current flowing through the second inductor winding 5, and $di_3/dt$ is the instantaneous current flowing through the first inductor winding 4.

At this time, since the first and second inductor windings 4, 5 are wound in the same direction and the currents ($I_3$, $I_4$) flow in the same direction, the mutual inductances ($M_{21}$, $M_{12}$) are additive to result in reduced ripple current and in increased current saturation levels for the inductor module 2.

From experimental results, both the conventional inductor module and the inductor module 2 of this embodiment were tested using a DC-to-DC power converter. It was found that the current saturation level in the conventional inductor module reached a value of 52A, while the inductor module 2 of the present invention still operates at a current of 70 A. The inductor module 2 of the present invention indeed operates at a higher current saturation levels.

Figure 4:
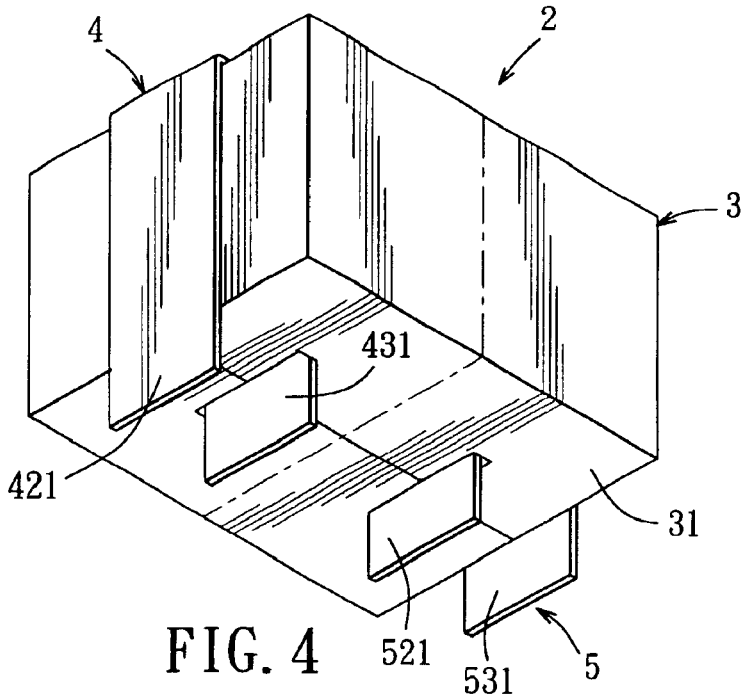
FIG. 4 is a perspective view of the second preferred embodiment of an inductor module according to the present invention.

FIG. 4 shows the second preferred embodiment of an inductor module 2 according to the present invention. This embodiment differs from the previous embodiment in that the input and output ends 421, 431, 521, 531 of each of the first and second inductor windings 4, 5 project transversely relative to the first surface 31 of the common inductor core 3. The input and output ends 421, 431, 521, 531 permit insert connection of the inductor module 2 with an electronic device (not shown).

It should be understood that the value of the inductances of each of the first and second inductor windings 4, 5 can be adjusted or the size of the inductor core 3 can be reduced by forming the inductor winding sections 40, 50 in a number of turns or by increasing the number of holes 35, 36 to increase the length of the inductor winding sections 40, 50, among many possible ways.

It has thus been shown that the inductor module 2 of this invention includes first and second inductor windings 4, 5 wound on a common inductor core 3. The construction as such permits the mutual inductances ($M_{12}$, $M_{21}$) of the first and second inductor windings 4, 5 to be additive in nature in order to reduce ripple current and to increase current saturation levels of the inductor module 2.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An inductor module comprising:

a common inductor core having first and second lateral core portions; and first and second inductor windings, each of which has an input end, an output end, and an inductor winding section disposed between said input and output ends, said inductor winding section of each of said first and second inductor windings being wound on a respective one of said first and second lateral core portions of said common inductor core such that said input end of said first inductor winding and said output end of said second inductor winding form a first distance therebetween and such that said output end of said first inductor winding said input end of said second inductor winding form a second distance therebetween, the second distance being smaller than the first distance, said output end of said first inductor winding being free of an electrical connection with said input end of said second inductor winding, said common inductor core including a first surface, a second surface opposite to said first surface, and a peripheral surface extending between said first and second surfaces, said common inductor core having a pair of through holes extending from said first surface through said second surface, said inductor winding section of said first inductor winding having a first segment extending from said output end of said first inductor winding and into a respective one of said through holes, a second segment extending from said first segment and along said second surface of said common inductor core, and a third segment extending from said second segment and along said peripheral surface of said common inductor core, said inductor winding section of said second inductor winding having a first segment extending from said input end of said second inductor winding and into a respective one of said through holes, a second segment extending from said first segment and along said second surface of said common inductor core, and a third segment extending from said second segment and along said peripheral surface of said common inductor core.

2. The inductor module as claimed in claim 1, wherein said inductor winding section of each of said first and second inductor windings is generally inverted-U in shape.

3. The inductor module as claimed in claim 1, wherein said input and output ends of each of said first and second inductor windings extend along and lie against said first surface of said common inductor core.

4. The inductor module as claimed in claim 1, wherein said input and output ends of each of said first and second inductor windings project transversely relative to said first surface of said common inductor core.

5. The inductor module as claimed in claim 1, wherein said common inductor core includes complementary core parts, each of which is formed with a pair of grooves, each of said through holes being defined by a confronting pair of said grooves in said core parts.

6. The inductor module as claimed in claim 1, wherein said common inductor core is made of a magnetic material.

7. The inductor module as claimed in claim 1, wherein each of said first and second inductor windings has an outer surface provided with an insulator layer.

8. An inductor module comprising:

a common inductor core having first and second lateral core portions; and first and second inductor windings, each of which has an input end, an output end, and an inductor winding section disposed between said input and output ends, said inductor winding section of each of said first and second inductor windings being wound on a respective one of said first and second lateral core portions of said common inductor core such that said input end of said first inductor winding and said output end of said second inductor winding form a first distance therebetween and such that said output end of said first inductor winding and said input end of said second inductor winding form a second distance therebetween, the second distance being smaller than the first distance, said output end of said first inductor winding being free of an electrical connection with said input end of said second inductor winding, each of said first and second inductor windings being formed from a conductive foil.

9. The inductor module as claimed in claim 8, wherein said conductive foil is made of copper.

10. The inductor module as claimed in claim 8, wherein said common inductor core is made of a magnetic material.

11. The inductor module as claimed in claim 8, wherein each of said first and second inductor windings has an outer surface provided with an insulator layer.

* * * * *